United States Patent [19]

Mace

[11] Patent Number: 4,472,844

[45] Date of Patent: Sep. 25, 1984

[54] TUB SHOWER SEAT

[76] Inventor: Ronald L. Mace, 530 North East St., Raleigh, N.C. 27601

[21] Appl. No.: 417,043

[22] Filed: Sep. 13, 1982

[51] Int. Cl.[3] ..... A47K 3/12

[52] U.S. Cl. ..... 4/579

[58] Field of Search ..... 4/578, 579, 604, 605, 4/611, 560–566, 559

[56] References Cited

U.S. PATENT DOCUMENTS

| | | | |
|---|---|---|---|
| 337,001 | 3/1886 | Kelley | 4/579 |
| 987,646 | 3/1911 | Schmidt | 4/579 |
| 1,197,657 | 9/1916 | Orofino | 4/579 |
| 1,240,479 | 9/1917 | Nichols et al. | 4/578 |
| 2,142,434 | 1/1939 | Bentz | 4/579 |
| 2,237,076 | 4/1941 | Kenney et al. | 4/579 |
| 2,788,055 | 4/1957 | Tumas | 4/565 |
| 2,834,968 | 5/1958 | Hefley | 4/578 X |
| 3,022,518 | 2/1962 | Hayden | 4/578 |
| 3,203,008 | 8/1965 | Murcott | 4/578 X |
| 3,289,217 | 12/1966 | Glover | 4/562 |
| 3,855,646 | 12/1974 | Glickman | 4/578 |
| 4,166,297 | 9/1979 | Saleeby | 4/578 |
| 4,168,549 | 9/1979 | Davies | 4/578 |
| 4,391,006 | 7/1983 | Smith | 4/579 X |

*Primary Examiner*—Charles E. Phillips

*Attorney, Agent, or Firm*—Bacon & Thomas

[57] ABSTRACT

A seat for mounting in a conventional bath tub is removably secured to a clamp bracket by which it may be clamped to a side wall of a bathtub so that it can be separated from the bracket and removed from the tub then repositioned in the tub in exactly the same position. The seat is spaced from the bracket to define a channel for a shower curtain and legs on the seat are adjustable in length while the attachment between the seat and bracket can be made at a selected one of a plurality of different heights.

7 Claims, 3 Drawing Figures

TUB SHOWER SEAT

BACKGROUND OF THE INVENTION

This invention is in the field of seats to be attached to a conventional bath tub to permit disabled or handicapped persons to sit in the tub while showering.

Such devices have been proposed before and attempts have been made to provide satisfactory seats for this purpose. Representative of such efforts are the devices shown in the U.S. Pat. Nos. to Hayden 3,022,518, Banoczi, 3,422,466, Bentz 2,142,434, Saleeby 4,166,297 and Glickman 3,855,646. The above patents each show devices having certain desirable features but none of which are completely satisfactory in applicant's view. They are mostly difficult for a disabled person to occupy especially when transfer must be made from a wheelchair or the like.

SUMMARY OF THE INVENTION

The present invention involves a main seat positionable within a conventional bath tub and having legs extending down to the bottom of the tub whereby the seat is supported in a stable position, the legs being adjustable as to height above the tub bottom. The seat is on a frame which is removably attachable to brackets that can be clamped on the side of the tub to facilitate the positioning of a separate seat portion or transfer board over the side wall of the tub and thus rendering it relatively easy for a person to transfer from a wheelchair or the like onto the shower seat. The separate seat portion over the tub side wall is spaced from the main seat and defines therebetween a channel for the reception of the lower portion of a shower curtain whereby the person taking a shower will not splash water outwardly of the tub, as is the case with the bulk of the prior art. The seat frame including the legs is removably attachable to the brackets whereby it can be removed from the tub to permit use of the tub by other persons and can again be reattached to the bracket in exactly the same position and height as previously determined. The seat is formed preferably of molded plastic material and includes an integral hand bar that the disabled person may grasp to facilitate transfer from the outer portion or transfer to the main seat within the tub. The seat is removable from its frame and can be reversed thereon so that the same is adaptable to either a right or left hand tub. The clamp bracket comprises relatively adjustable parts that are padded with rubber to prevent damage to the surface of the tub and which can be securely clamped to the side wall of the tub and left there in permanent proper position.

DESCRIPTION OF THE PREFERRED EMBODIMENTS

Figure 1:
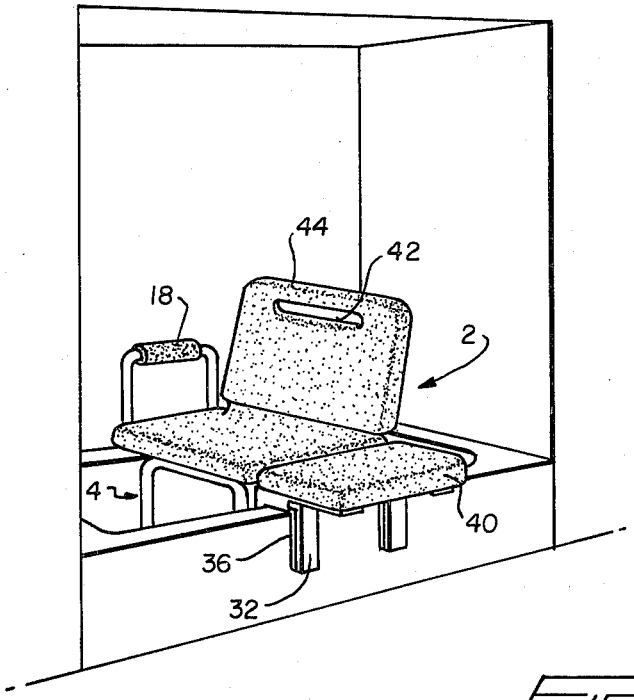
FIG. 1 is a schematic perspective view of a seat mounted in a conventional tub.

As shown in the drawings, the seat comprises a main seat portion 2, preferably a one-piece molded structure, molded from a suitable plastic material that is waterproof and therefore not subject to deterioration upon repeated use in a shower. It is contemplated that the seat may be provided with a cushion for the use by persons unable to sit on a hard seat although such cushion should be sealed in a waterproof covering. The cushion may be attached by straps or mechanical fasteners so that it can be removed for cleaning or removed so that the seat may be used by persons who do not require such a cushion.

The seat is contemplated to be secured to a support frame 4 by means of bolts or the like (not shown) engageable in openings 6 in the frame 4. The frame is a pair of generally U-shaped bent tubing members provided with feet 10 which are adjustable therein by means of threaded devices 12 or the like by which the length of the leg may be adjusted. The shorter legs of the U-shaped support frame members are secured to L-shaped members 14. As shown, each of the members 14 comprises a vertically extending or upstanding plate-like member and a horizontal flange projecting inwardly from its lower end and to which the short legs of the support frame are permanently attached, in spaced relation to the vertically extending plates. Each of the vertical plates is provided with an opening or the like 16 by which the support frame may be attached to clamp brackets as will be described.

Also provided is a handle or arm rest 18 that may be secured to the support frame 4 by bolts or the like entering into openings 20 in the arm rest and openings 22 in the support frame.

Clamp brackets 24 each comprises a first L-shaped portion 26 having a downwardly extending leg 28 provided with a pad 30 of rubber or the like to be engaged with the inner surface of the side wall of the conventional tub. In slidable relation to the upper and generally horizontal leg of the first L-shaped member 26 is a further L-shaped clamp member 32 slidable along the upper plate 26 and adjustable thereon by means of any suitable means shown schematically at 34. This plate 32 likewise carries a rubber pad 36 on its downwardly extending leg to prevent marring the surface of the tub. The vertically extending leg 28 of the portion 26 is provided with a series or multiplicity of openings 38 by which the vertically extending plates of support frame 4 may be attached to the bracket. It is contemplated that some quick releasable fastening means be employed whereby the seat and its support frame can be removed from the clamp brackets to remove the main seat from the tub when desired and whereby the seat can be repositioned in the tub by reinserting the quickly operable fastening means to reposition the seat in exactly the same position that it initially occupied. An outer seat portion or transfer board 40 is also provided and is preferably of molded plastic material and adapted to be secured to the upper plates 26 of the clamp brackets to form an outward continuation of the main seat 2, as shown in FIG. 1. Thus, a person in a wheelchair can easily transfer to the seat portion 40, then slide over onto the main seat 2 without assistance provided he or she can lift his or her legs over the side wall of the tub.

As shown in the drawings, the seat back of main seat 2 is provided with a longitudinal slot 42 near the top thereof, thus forming with the top edge of the seat a suitable bar 44 adapted to be grasped by a user to assist the person in sliding from transfer board 40 to the main seat 2.

Figure 2:
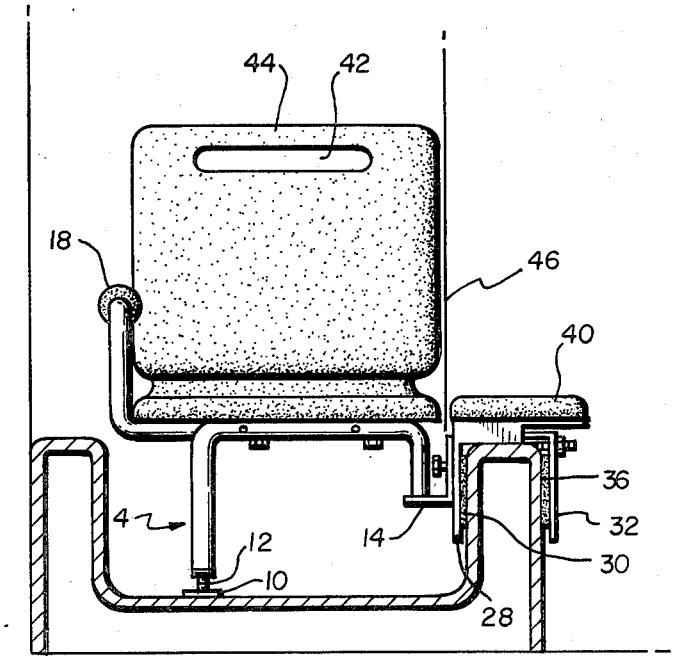
FIG. 2 is a schematic sectional view showing the seat and its relation to the tub when mounted therein.
Figure 3:
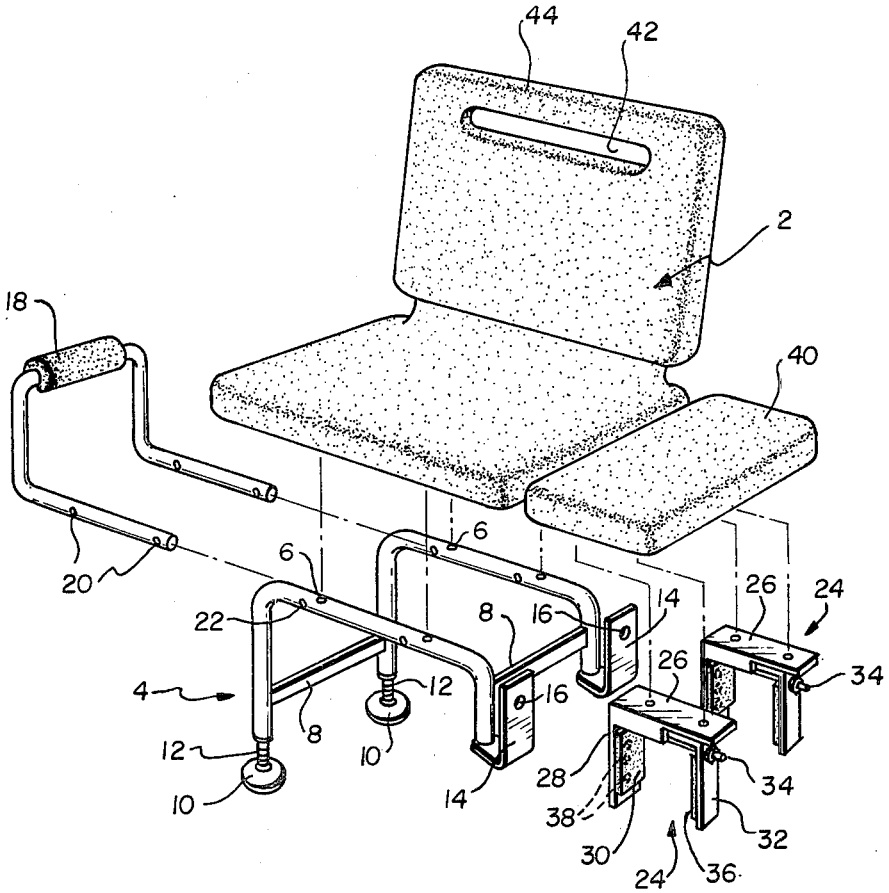
FIG. 3 is an exploded view of the novel seat of the present invention and the parts thereof.

As also clearly evident from the drawings, the U-shaped portions of the support frame for the seat are fastened to the members 14 in spaced relation to their vertically extending plates, thereby providing a space for a shower curtain (identified by numeral 46 in FIG. 2) so that the shower curtain may be opened or closed with ease by a person occupying the main seat 2. As is apparent, the main seat 2 is symmetrical in shape and can be disconnected from the support frame 4 and turned to face the other direction, without disturbing any adjustments.

While a single specific form of the invention has been shown and described herein, the same is merely illustrative of the principles involved and other forms may be resorted to within the scope of the appended claims.

I claim:

1. A transfer seat arrangement to facilitate the movement of an infirm person or invalid from outside a bathtub to a position at least partially within a bathtub having a bottom and an upstanding side wall, and seat comprising:

a bracket structure configured to overlie said side wall; said bracket structure including a first portion to be disposed outside the tub to overlie the outside of the tub side wall, a second portion to be disposed inside the tub to overlie the inside of the tub side wall and a third portion to be disposed along the top of the tub side wall; said third portion including transfer board means having a generally planar top surface extending horizontally in the direction along the longitudinal extent of the tub wall and extending horizontally in the direction transverse to the longitudinal extent of the tub wall; said second portion having first quick connect and disconnect means;

a support frame; said support frame having downwardly extending leg means arranged to be engageable with the bottom of the tub to support the support frame relative to the tub; main seat support means extending generally horizontally from said downwardly extending leg means; main seat means having a generally horizontally planar top surface and supported from below by said main seat support means; said main seat support means including a junction portion on one end of said main seat support means; said junction portion having shower curtain channel means for receiving a shower curtain below the upper edge of the tub side wall and within the tub; said junction portion having second quick connect and disconnect means engageable with said first quick connect and disconnect means, so that the support frame including the main seat support means and shower curtain channel means may be quickly placed in the tub and connected to the bracket structure including transfer board means, and so that the support frame including the main seat support means and shower curtain channel means may be removed from the tub by being quickly disconnected from the bracket structure including transfer board means thereby leaving only the support frame and transfer board means in engagement with the tub wall.

2. A seat as claimed in claim 1 wherein said bracket structure contains means to clamp said bracket structure to the sidewall of the tub.

3. A seat as claimed in claim 1 wherein the first and second quick connect and disconnect means have selectively interengageable means so that the support frame may be secured to the bracket structure at a selected elevation and wherein the leg means of the support frame are selectively adjustable, whereby the elevation of the main seat means is selectively adjustable.

4. A seat as claimed in claim 3 wherein the top surface of the main seat means is positionable at an elevation level which is the same general elevation level as the top surface of the transfer board means whereby the tub user can easily slide from the transfer board means to the main seat means.

5. A seat as claimed in claim 1 wherein said shower curtain channel means includes an upstanding element and a generally horizontally projecting element at the lower end of said upstanding element, said horizontally projecting element extending away from said bracket structure and towards said downwardly extending leg means.

6. A seat as claimed in claim 5 wherein said upstanding element is a flattened plate element and said horizontally projecting element comprises a flange portion of said plate element.

7. A seat as claimed in claim 6, said support frame including a downwardly extending section attached to said flange portion in spaced relationship with said plate element, the space between the downwardly extending section and the plate element defining said channel.

* * * * *